US006250491B1

(12) United States Patent
Lee

(10) Patent No.: US 6,250,491 B1
(45) Date of Patent: Jun. 26, 2001

(54) SIDE OPENABLE CAN

(76) Inventor: Tae-young Lee, 103-ho, A-dong, 149-48, Yeonhee 3-dong, Seodaemun-gu, Seoul 120-113 (KR)

( * ) Notice: Subject to any disclaimer, the term of this patent is extended or adjusted under 35 U.S.C. 154(b) by 0 days.

(21) Appl. No.: 09/447,477

(22) Filed: Nov. 23, 1999

(30) Foreign Application Priority Data

Aug. 13, 1999 (KR) ..... 99-16684

(51) Int. Cl.[7] ..... B65D 17/34

(52) U.S. Cl. ..... 220/269; 220/661; 220/906; 222/528; 222/535

(58) Field of Search ..... 220/269, 906, 220/661; D9/518, 438, 447; 222/528, 535

(56) References Cited

U.S. PATENT DOCUMENTS

D. 327,424 * 6/1992 Pierce ..... D9/518
3,980,214 * 9/1976 Dahlquist ..... 220/269 X
4,561,557 * 12/1985 Park et al. ..... 220/906 X
5,415,313 * 5/1995 Sang-Seo ..... 220/269
5,556,004 * 9/1996 Brucker ..... 222/535 X
5,685,464 * 11/1997 Krueger ..... 222/528
5,743,445 * 4/1998 Benarrouch ..... 220/269 X
6,015,060 * 1/2000 Rightenour et al. ..... 220/269

* cited by examiner

*Primary Examiner*—Nathan J. Newhouse
(74) *Attorney, Agent, or Firm*—Christie, Parker & Hale, LLP

(57) ABSTRACT

A side openable can is disclosed. The side openable can has a bottom sealed end, a sidewall and a top sealed end. An opening means for producing an opening at the upper portion of the sidewall, is provided on the upper portion of the sidewall. In another embodiment, the opening means may have a tear flap formed integrally in the upper portion of the sidewall of the can and defined by a tear line. A tear lever is fixed to the outside surface of the tear flap and used for tearing the tear flap away from the can. A spout holder has a holding rim and a support rib. The spout holder is attached interiorly to the sidewall of the can with a front surface of the holding rim interiorly bonded to the sidewall of the can around the tear flap, the holding rim having an insertion slit along its inside edge. The support rib has a depression. In addition, a drinking spout has an insertion flange and an elastic expansion part. The insertion flange is formed along the side edge of the elastic expansion part and is inserted into and fixed by the holding rim of the spout holder. The elastic expansion part is elastically expanded upon tearing away of the tear flap.

1 Claim, 5 Drawing Sheets

SIDE OPENABLE CAN

BACKGROUND OF THE INVENTION

1. Field of the Invention

The present invention relates, in general, to cans and, more particularly, to a side openable can having a bottom sealed end, a sidewall and a top sealed end, comprising opening means for producing an opening at the upper portion of the sidewall, the opening means being mounted to the upper portion of the sidewall.

2. Description of the Prior Art

As well known to those skilled in the art, a conventional can comprises a bottom sealed end, a sidewall, a top sealed end and an opening means, the opening means being typically positioned on the top sealed end.

Pursuant to the conventional can, when the front portion of a tear lever is pulled upward, the rear portion of the tear lever presses a tear flap downwardly by leverage, thereby partially separating the tear flap from the top of the can. In such a case, the partially separated tear flap is pushed into the interior of the can.

However, the conventional opening means is unhygienic and causes a user inconvenience in drinking. That is, dusts and impurities, adhering to the top of the can during storage and circulation, may get into the interior of the can in the process of opening the can. Further, such dusts and impurities may get into the user's mouth in the process of drinking the beverage of the can. And, since the opening means is provided on the top of the can, in order to drink the beverage from the can, it must be turned upside down, thus causing inconvenience to the user having to lean his neck backwards. Additionally, the entire beverage is not discharged from the can and a small amount of beverage remains because the opening is formed to be spaced apart from the top edge of the sidewall of the can.

SUMMARY OF THE INVENTION

Accordingly, the present invention has been made keeping in mind the above problems occurring in the prior art, and an object of the present invention is to provide a side openable can hygienic and convenient to use.

In order to accomplish the above object, the present invention provides a side openable can having a bottom sealed end, a sidewall and a top sealed end, comprising opening means for producing an opening at the upper portion of the sidewall, the opening means being mounted to the upper portion of the sidewall.

In another embodiment, the opening means comprises a tear flap formed integrally in the upper portion of the sidewall of the can and defined by a tear line, a tear lever fixed to the outside surface of the tear flap and used for tearing the tear flap away from the can, a spout holder having a holding rim and a support rib, the spout holder being attached interiorly to the sidewall of the can with a front surface of the holding rim interiorly bonded to the sidewall of the can around the tear flap, the holding rim having an insertion slit along its inside edge, the support rib having a depression, and a drinking spout having an insertion flange and an elastic expansion part, the insertion flange being formed along the side edge of the elastic expansion part and being inserted into and fixed by the holding rim of the spout holder, the elastic expansion part being elastically expanded upon tearing away of the tear flap.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENT

Figure 1:
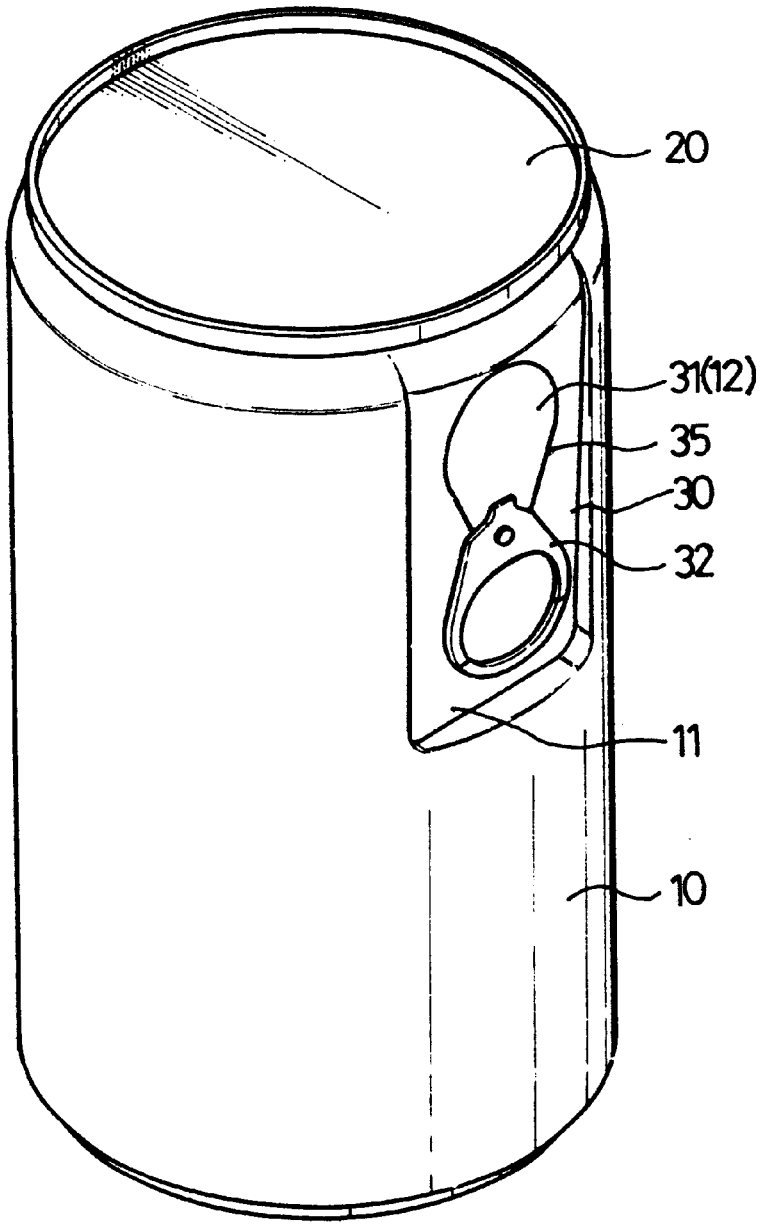
FIG. 1 is a perspective view, showing the construction of a side openable can according to the preferred embodiment of this invention.
Figure 2:
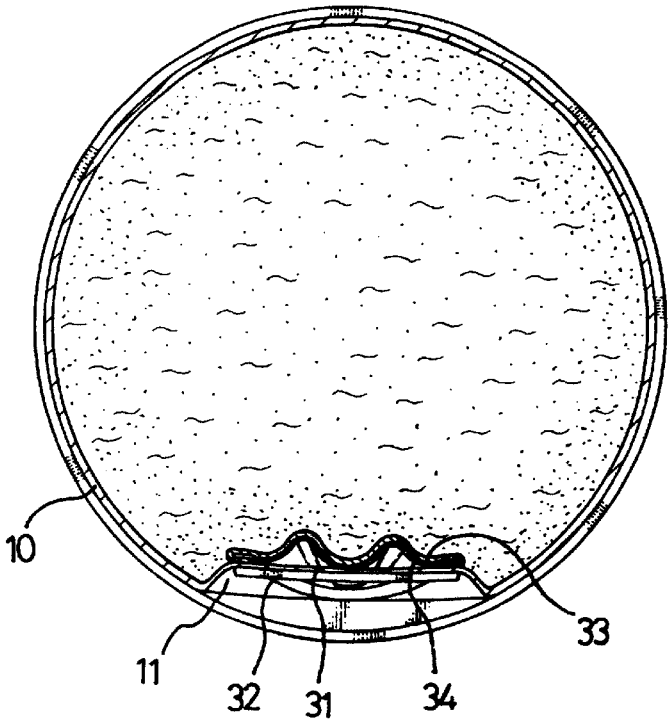
FIG. 2 is a cross sectional view of FIG. 1.
Figure 3:
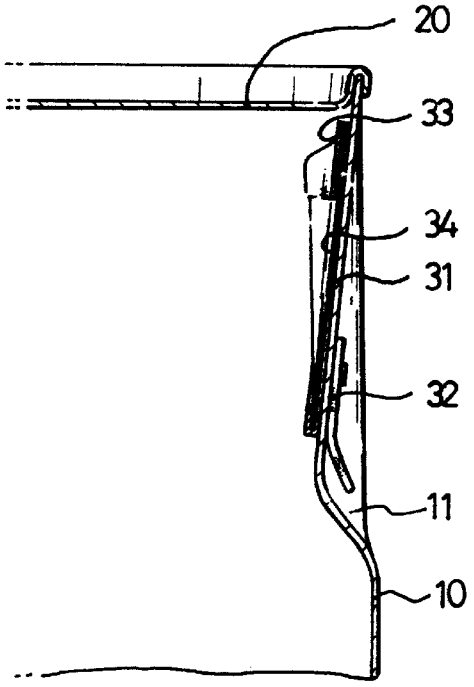
FIG. 3 is an enlarged sectional view, showing the opening means of the side openable can.
Figure 4A:
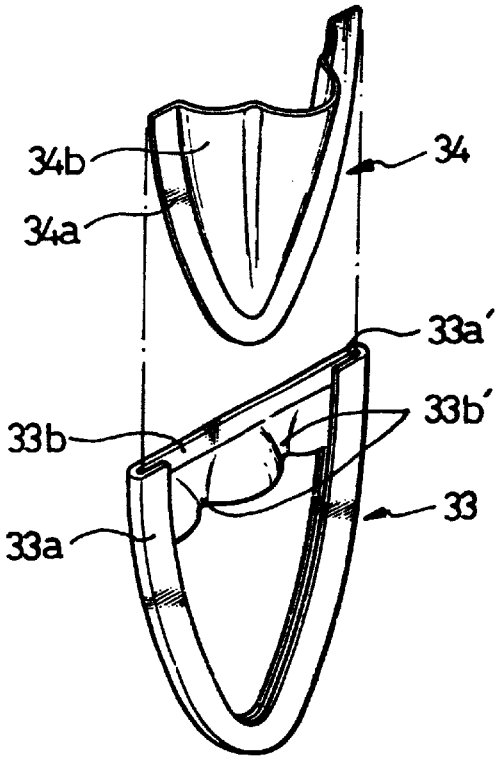
FIG. 4*a* is an exploded perspective view of a drinking spout and spout holder assembly.
Figure 4B:
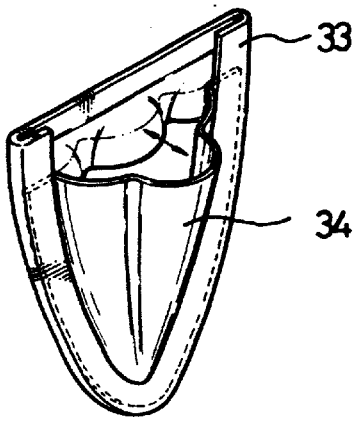
FIG. 4*b* is a perspective view with the drinking spout and spout holder assembled.
Figure 5:
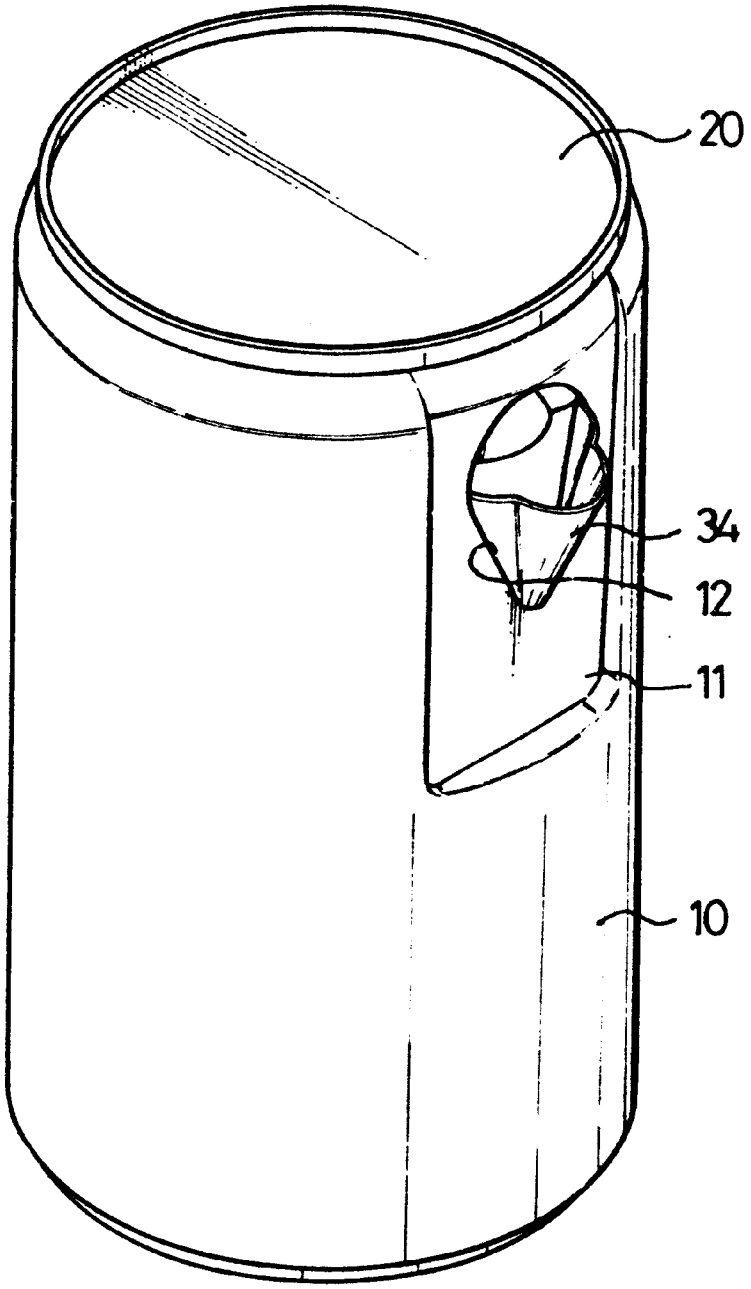
FIG. 5 is a perspective view of the side openable can, with a tear flap being torn away from the sidewall of the can.
Figure 6:
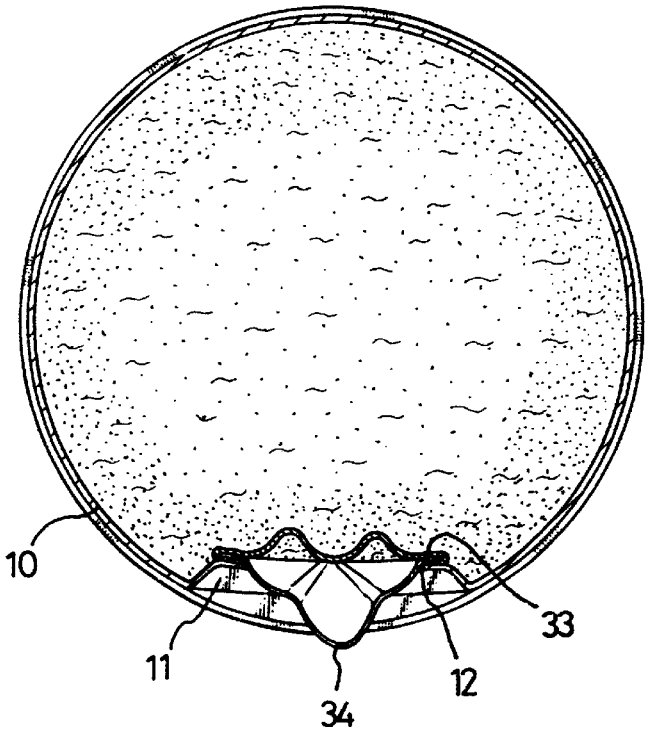
FIG. 6 is a cross sectional view of FIG. 5.
Figure 7:
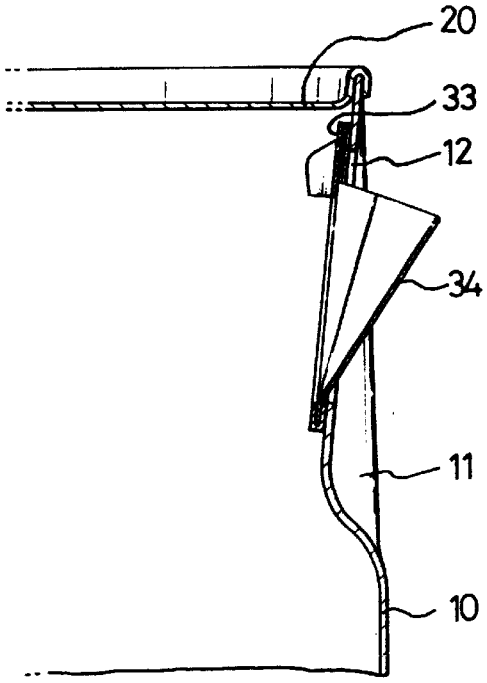
FIG. 7 is a enlarged sectional view, showing the opening means of the side openable can with a tear flap being torn away from the sidewall of the can.

As shown in the accompanying drawings, a side openable can according to the preferred embodiment of this invention comprises a bottom sealed end (not shown), a sidewall 10, a top sealed end 20 and an opening means 30. In the interior of the can, there are contained liquid contents, such as a beverage.

The constructions of the bottom sealed end, sidewall 10, and top sealed end 20 of the can are the same as those of a conventional can, respectively.

The opening means 30 is mounted at the upper portion of the sidewall 10. In general, the opening means 30 is positioned within a recess 11 of the sidewall 10, the recess 11 being formed in the upper portion of the sidewall 10. The opening means 30 consists of a tear flap 31, a tear lever 32, a spout holder 33 and a drinking spout 34.

In order to allow a can opening 12 to be produced, the tear flap 31 is integrally formed in the upper portion of the sidewall 10 and is defined by a tear line 35. The tear lever 32 is riveted to the outside surface of the tear flap 31 so as to allow the tear flap 31 to be torn away from the sidewall 10 of the can. The tear lever 32 is preferably bent upwardly for ease of grip. The spout holder 33 consists of a rounded V-shaped holding rim 33*a* and a support rib 33*b* . The rounded V-shaped holding rim 33*a* has an insertion slit 33*a'* along its inside edge, while the support rib 33*b* has two spaced depressions 33*b* '. The spout holder 33 is interiorly attached to the sidewall 10 of the can, with the rounded V-shaped front surface of the holding rim 33*b* being interiorly welded to the sidewall 10 around the tear flap 31. In this embodiment, the mounting of the spout holder 33 may be performed by a known bonding process, such as an electric welding process. The drinking spout 34 has an insertion flange 34*a* and an elastic expansion part 34*b*. The above insertion flange 34*a* is formed along the edge of the expansion part 34*b*, which is made of an elastic material, such as an elastic thin metal plate or a non-toxic plastic plate. The drinking spout 34 is assembled with the spout holder 33, the insertion flange 34*a* of the spout 34 being inserted into and being fixed within the insertion slit 33*a'* of the holding rim 33*b* of the spout holder 33.

The operation of the embodiment is described in the following.

In the closed state, the drinking spout 34 is tightly pressed against the support rib 33*b* of the spout holder 33 by the tear flap 31. As a result, the elastic expansion part 34*b* of the drinking spout 34 is elastically deformed into the curvature of the support rib 33*b* of the spout holder 33, thus preventing the beverage of the can from getting out of the can.

In order to open the can, the lower portion of the tear lever 32 is pulled upward while a user is facing the can. In such a case, the can is easily opened by levering the tear lever 32 with the index finger while the thumb presses down on the top 20 of the can to stably hold the can during removal of the tear flap 31.

When the tear lever 32 is completely pulled upward, the tear flap 31 is completely separated from the can, thereby producing the can opening 12 in the sidewall 10 of the can.

As the tear flap 31 is separated from the sidewall 10 of he can, the drinking spout 33, which was pressed down by the ear flap 31, is elastically projected forward out of the sidewall 10 of the can. The force for projecting the drinking spout 33 is a restoring force of the elastic expansion part 34*b*.

As described above, the present invention provides a side openable can having below-mentioned effects.

Since the opening means of the can is provided on the sidewall 10 of the can, dusts and impurities accumulated on the top 20 of the can do not get into the interior of the can during opening of the can or into the user's mouth during drinking the beverage of the can. Therefore, the can is able to be considered hygienic.

The beverage is easily discharged and reliably follows the channel of the drinking spout 33 because the drinking spout 33 is projected out of the sidewall 10 of the can at an angle. Consequently, the beverage expectedly gets into a user's mouth.

Since the opening of the can is provided on the sidewall of the can, the beverage may be fully discharged from the can at the angle of 90°, thus allowing a user the convenience of not having to excessively lean his neck backward.

The beverage may be totally removed from the can because the opening of the can is positioned at the lowest level during drinking.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A side openable can having a bottom sealed end, a sidewall and a top sealed end, and including opening means for producing an opening at an upper portion of the sidewall, said opening means comprising:

a tear flap formed integrally in said upper portion of the sidewall of the can and defined by a tear line;

a tear lever fixed to an outside surface of said tear flap and used for tearing said tear flap away from the can;

a spout holder having a holding rim and a support rib, said spout holder being attached interiorly to said sidewall of the can with a front surface of said holding rim interiorly bonded to said sidewall of the can around the tear flap, the holding rim having an insertion slit along its inside edge, said support rib having a depression, and a drinking spout having an insertion flange and an elastic expansion part, said insertion flange being formed along a side edge of the elastic expansion part and being inserted into and fixed by said holding rim of the spout holder, said elastic expansion part being elastically expanded upon tearing away of said tear flap.

* * * * *